United States Patent [19]

Zlamal

[11] Patent Number: 4,900,484

[45] Date of Patent: Feb. 13, 1990

[54] CERAMIC WELDING COMPOSITION AND PROCESS

[75] Inventor: Frank Zlamal, Eureka Springs, Ark.

[73] Assignee: Northlake Marketing and Supply Company, Hobart, Ind.

[21] Appl. No.: 105,861

[22] Filed: Oct. 8, 1987

[51] Int. Cl.[4] ..... F27D 1/16

[52] U.S. Cl. ..... 264/30; 501/125

[58] Field of Search ..... 264/30; 501/125

[56] References Cited

U.S. PATENT DOCUMENTS 2,741,822 4/1956 Udy ..... 264/30

3,684,560 8/1972 Brichard ..... 264/30

4,489,022 12/1984 Robyn ..... 264/30

*Primary Examiner*—James Derrington

*Attorney, Agent, or Firm*—John C. Brezina

[57] ABSTRACT

A mixture of powdered metals and oxides used in ceramic welding for repairing fire brick linings of industrial ovens by blowing the powdered mix on hot oven walls in a stream of oxygen, where the powders have the characteristics providing for initial ignition of the stream of particles in the flame zone before they strike the oven wall and the oxidation continues after the particles form refractory mass on the oven wall.

7 Claims, No Drawings

CERAMIC WELDING COMPOSITION AND PROCESS

This invention provides an advantageous oxidizable refractory in a process known as ceramic welding for the repair of industrial furnaces or ovens, especially coke ovens. In particular, the composition is a dry mixture of finely divided and intimately admixed components which permit a high degree of control over the oxothermic oxidation reaction as the mixture is sprayed onto a hot oven wall.

BACKGROUND OF THE INVENTION

Various processes for ceramic welding have been known since at least the 1930's using an exothermically reactive composition containing a major portion of relatively inert and noncombustible refractory material similar to or compatible with the brick lining of the oven or furnace to be repaired. The source of exothermic heat is provided by powdered metals, such as aluminum, magnesium and silicon. The combination of the powdered metal and refractory material as a dry powdery mix blown or "blasted" onto the hot oven walls with equipment which is similar to ordinary sand blasting equipment, generally requiring a high-pressure stream of oxygen to carry and blow the powdered material onto the place of damage where the oven is to be repaired. A long hollow wand is used by the operator to direct the material. The powdery material may ignite when it hits the hot surface of the oven or else, as recommended in earlier processes, supplementary flame ignition means are used.

The object of ceramic welding processes is to cause the reacted material to firmly adhere to the walls of the oven and provide a long lasting wall repair. The composition which fills the cracks or gaps in the damaged wall is altered by the heat of reaction to yield a repair material as physically and chemically similar to the original oven wall material as possible. The built up repair must be not only durable under normal furnace or oven operation, and must also have satisfactory refractory characteristics. The repair patch or renewed refractory lining should resemble the physical characteristics of fire brick normally used to line such ovens, i.e. so as to be somewhat porous rather than being so vitreous or glass-like as to break or crack under thermal stresses. At the same time, excessive porosity must be avoided to achieve a reasonably solid, brick-like consistency of the hardened or fused refractory material.

PRIOR ART

Early effort to repair oven walls by ceramic welding, using powdered materials blown onto the hot surfaces of the damaged walls, are illustrated by two publications of the British Institute of Gas Engineers dated 1933 and 1938, by U.S. Pat. No. 2,741,822 and by Swedish Pat. No. 102,083 dated May 15, 1941. More recent processes are set forth by two commonly assigned patents, one to Brichard et al, U.S. Pat. No. 3,684,560 dated Aug. 15, 1972, and another to Robyn et al, U.S. Pat. No. 4,489,022 dated Dec. 18, 1984, with corresponding patents issuing in various countries.

The 1933 British publication, Bull. B.R.A., No. 32, 1933 is entitled "Report on Work Carried Out by the British Refractory Research Association", and carries the article:

"No. 1 The Hot Patching Of Gas Retort PART II Experiments on the use of Dry Powder Cement Containing Silicon and Aluminum".

This article shows experiments using a finely powdered aluminum and/or silicon metal as an exothermic agent combined in an amount of about 25% by weight together with 75% by weight of a powdered siliceous, semi-silica or silica fire brick. This mixture is applied at a temperature of about 1250° C. using a stream of oxygen or oxygen-enriched air. The 1938 publication, "Institute of Gas Engineers, Communication No. 198", Nov. 1–2, 1938, entitled "Hot Patching of Retorts by Spray Welding", describes similar processes with the ignition of the dry repair material as it is blown on the wall by means of external gas or other flame, just as in the earlier 1933 article.

The Swedish Patent discloses a method using finely powdered combustible exothermic components, namely aluminum, silicon or other metals having a granular size of less than 0.1 mm (100 microns). A major part of the powdered mix consists of ground refractory or ceramic powders having a grain size of less than 1.0 mm. The patent teaches that a repair can be accomplished in a hot oven without the necessity of cooling. The mixture is blown in place with a stream of oxygen, and in starting up the oxidation process, it is said to be advantageous to use additional heating of the powder mass when it leaves the projector, blower, centrifuge, etc. Such additional heat is supplied with a gas, oil or coal dust flame. To assist in oxidation, use of an "acid-rich oxide" is recommended, such as chrome oxide or chromates, manganese super oxide (brown stone) or other compounds which give off oxygen when heated, such as nitrates (calcium nitrate) and chlorates.

The Brichard et al U.S. Pat. No. '560 discloses a process utilizing a dry powdered mixture of a combustible or exothermic component, preferably one or metals, such as aluminum or silicon, added to powdered refractory materials which are fused or partially melted and blown onto the surface of the oven to be repaired, preferably utilizing a stream of pure oxygen. This patent emphasizes the importance of the particle size of both the metal and refractory components. The proportion of the metallic powder is claimed to be in the range of 20 to 30% (although one example shows a proportion of 12%), and the metal powder must have an average particle size of less than 50 microns, preferably less than 10 microns.

The Robyn et al U.S. Pat. No. '022 is said to be an improvement over the same assignee's '560 patent. Robyn et al require both metallic powdered aluminum and silicon of the same small particle size as '560 with the two metal powders together representing less than 20% by weight of the total mixture, preferably about 10–15% by weight.

It is apparent that these known ceramic welding processes take place at approximately 4,000° F., resulting in complex oxidation and reduction reactions. The final fused product is a material consisting of complex molecules (like natural rocks) and analysis of the end product and exactly how it is formed is quite difficult if not impossible.

In developing the present invention, it became clear that in the prior art most of the exothermically reacting materials were oxidized when the materials are in the flame zone between the nozzle of the wand applicator and the wall of the oven. To create a good weld and a fused product which is strongly adherent to the wall on which it is applied, and which builds up a material of the proper porous but hard consistency, it is also necessary to have a reaction which continues beyond the time the material travels the few inches from the nozzle to the oven wall. It is one object of the invention to ensure that the metallic particles are completely converted to oxides such as aluminum-oxide, which then forms part of the refractory, and do not remain in the repaired area in their metallic form. The addition of oxiding chemicals was recognized in the Swedish Patent. However, the materials offered by the Swedish Patent, such as nitrates (calcium nitrate) and chlorates, albeit oxidizers, are very unsatisfactory because in the presence of the slightest moisture, they react prematurely with the very fine particles of aluminum powder. If these fine aluminum particles react too early, e.g. in storage or in the flame zone, they do not provide a proper ignition reaction for the welding process.

It is another object of the invention to provide an effective oxidizing agent which remains dry and unreactive in the stored refractory composition but which will supply oxygen at the high exothermic reaction temperatures on the wall of the oven, thereby ensuring that the reaction is sustained for at least several minutes after initial application.

The compositions and procedures used in the prior art are extremely dangerous and have caused devastating explosions with loss of life, particularly when using very finely powdered aluminum, especially with an average size in the range of 50 microns down to 10 microns or less. Powdered aluminum is a known igniter for explosives and is used in solid rocket propellants. The hazards in using such an ignition agent cannot be overemphasized. It is a particular object of the present invention to substantially reduce the danger of explosions by using materials and procedures which offer greater control over the ignition and exothermic reaction of the ceramic welding material.

These and other objects and advantages of the invention will become apparent in the following detailed disclosure together with preferred embodiments of the invention.

SUMMARY OF THE INVENTION

It has now been found, in accordance with the invention, that it is possible to achieve superior repairs on damaged oven walls, especially coke oven walls, under much more highly controlled conditions where the initial wall temperature is no higher than about 2000° F., and especially about 600° to 1800° F., by using a specially formulated welding composition and also by varying the proportion of pure oxygen to air in the transporting or carrier gas depending on the initial wall temperatures and the subsequent exothermic reaction temperatures.

The welding material or powdery oxidizable refractory composition of the invention requires the following components in intimate admixture:

(A) a substantially noncombustible refractory material in a major proportion with reference to the total weight of the composition;

(B) exothermically oxidizable metal components consisting essentially of (1) a granular aluminum powder having a size range of about 70 to 150 microns in a proportion of about 8 to 12% by weight with reference to the total composition and (2) a finely grained aluminum powder or equivalent flake in which the powder has a size range of less than 5 microns and the flake has an equivalent size by volume, in a proportion of about 2 to 6% by weight with reference to the total composition; and (C) a group of control components consisting essentially of (1) iron oxide of the formula $Fe_2O_3$ with a particle size of about 80 microns or less in a proportion of about 2 to 10% by weight with reference to the total composition, (2) a dross obtained as the byproduct of aluminum smelting, preferably containing about 15–25% Al, 60–70% $Al_2O_3$ and 10–15% NaCl or KCl, said dross having a particle size of about 70 microns or less and being used in a proportion of about 1 to 7% by weight off the total composition, and (3) a fluorspar having a fluoride content of at least about 70%, said fluorspar having a particle size of about 150 microns or less and being used in a proportion of about 2 to 7% by weight with reference to the total composition.

This welding material for oven repair includes a major portion of essentially nonreactive, i.e. non-oxidizable, refractory material composed of various oxides including silica, magnesium oxide and a variety of oxides and combinations thereof commonly used as components of fire brick. A good refractory component for the powdered repair mix is a ground up brick of the same type used in the furnace to be repaired. This refractory substance is generally used in the powdered mix in a proportion of about 55 to 85%, preferably about 65 to 80% and especially 70 to 75% by weight.

The metallic exothermic component of the welding composition is aluminum powder which must be present in two distinct forms. One form is a comparatively "coarse" granular aluminum powder in the size range of about 70 to 150 microns, being present in the composition to the extent of about 8 to 12% by weight and preferably about 9 to 11% by weight of the total mix. The second form of aluminum powder has a much finer grain size of about 5 microns or smaller, i.e. a size which passes through a −325 mesh screen. This very finely grained aluminum powder is used in a proportion of about 2 to 6% and preferably between about 3 and 4%, e.g. about 3½%, by weight of the total mix.

Flake aluminum can be used in place of or in admixture with the very fine aluminum powder, with an average size of 37 microns, measured as the greatest diameter of the flat flake. The thickness of the flake aluminum is usually extremely small, e.g. about 1 or 2 microns, so that the equivalent size of the flake in terms of total volume is quite similar to the total volume of a powder with a size of less than 5 microns. This finely powdered or flaked aluminum aluminum serves as the essential igniter causing the mixture to ignite when blown against a hot wall in the presence of oxygen.

This fine aluminum will ignite at temperatures between about 1500°–1800° F., depending upon the ratio of pure oxygen to air in the carrier gas, and the oven wall temperature commonly ranges from 1100° to 2000° F. for coke ovens. At temperatures above about 1800° F., air without added oxygen is sufficient to cause ignition. Very fine aluminum powders and flakes of less than 5 microns are also used as a component for explosives used for blasting, and the quantity used according to the invention must be sufficient to provide the initial ignition but sufficiently low to minimize the chance of any explosive reaction. In general, the amount of fine aluminum may be decreased with increasing wall temperatures.

The coarser form of powdered aluminum is used in this invention as part of the sustained exothermic reaction on the oven walls and is effective in combination with the other control components to provide a continuing reaction on the order of several minutes. In contrast, the prior art offers only oxidizing components which supply oxygen from the oxygen of the propelling gas or powdered oxidizing agents such as those referred to in the Swedish patent. These solid powdery oxidizing agents, however, tend to oxidize immediately as soon as the mixture enters the flame while the welding material is carried toward the wall. Thus, the prior art does not offer a sustained reaction on the oven walls.

The third group of components required by the invention may be identified as "control" chemicals. These provide both oxidizing and oxidizable elements which break down to freely reactive atomic elements at the high temperatures of the sustained exothermic reaction. The first control component is iron oxide as $Fe_2O_3$, used in an amount of about 2–10%, preferably 5–8% and especially about 6–7% by weight of the total mixture, with a particle size of −200 mesh or about 75 microns or less. The iron oxide appears to act as an oxidizing agent in that at the high oxothermic temperatures, it breaks down with a release of oxygen atoms which can then react with the aluminum and other oxidizable atoms. It is believed that the iron atoms combine with the other materials to form compounds such as metallic refractory oxides.

The second control material which is a component of the powdered welding material is the dross which is obtained as a byproduct of aluminum smelting. It is added in a particle size of −20 mesh or about 840 microns or less, i.e. a relatively coarse powder. It consists of about 20% by weight metallic aluminum, about 60 to 70% by weight aluminum oxide $Al_2O_3$ and about 10 to 15% by weight of combined sodium chloride (NaCl), and potassium chloride (KCl). The metallic aluminum and aluminum oxide are believed to enter into the exothermic reaction similar to the main reaction noted above, but possibly at a slower rate. This component comprises about 1–7%, preferably about 2–6% and especially about 2–3% by weight of the total composition.

The third control component is fluorspar, i.e. calcium fluoride, which is believed to be a source of fluorine in the reaction. While commercial grades of fluorspar contain about 85% by weight of the fluoride ($C_aF_2$), it is possible to use lower grades with a fluoride content of about 70% or more. The fluorspar is added in powdered form with a mesh size of −100, or about 150 microns or less and makes up about 2–7%, preferably about 3–5% and especially about 3–4% by weight of the total mixture. This percentage may vary more widely depending upon the fluoride content. The range is usually about 2–5% depending how reactive a material is needed for application to either cold or hot surfaces. Since chlorine and fluorine atoms react similarly at the high temperatures of the exothermic reaction, the proportion of each may vary to some degree based on the percentage of total chlorine and fluorine atoms available in the reaction.

These sources of chlorine and fluorine atoms, i.e. the dross and the fluorspar, respectively, affect the color and shape of the flame and may be varied to adjust the flame according to size and color. The reactivity of the welding material is also adjusted or controlled by using the flame in an oven with a wall temperature in the middle range, e.g. 1200°–1500° F., using a pure oxygen stream as a carrier of the powdered materials. To reduce the reactivity, the gas stream is adjusted to decrease the proportion of oxygen and increase the proportion of air. To increase reactivity, the proportion of pure oxygen is increased. After some experience, an operator can judge the reactivity of the composition by the size and color of the flame.

Temperatures of the walls of furnaces or ovens will vary greatly depending on the time period the source of heat is removed or the furnace or oven is opened. The wall portions nearest the doors or openings will cool much more rapidly and extensively than the inner portions. The control components of the invention permit the opertor to regulate the rate of ignition and achieve a sustained reaction under a very wide range of oven conditions by (1) using a selected mix of components adapted to the overall temperature conditions expected in a particular oven, and (2) by adjusting the ratio of pure oxygen to air to provide an even finer control.

When the temperatures reach a temperature below about 600° to 800° F., such as happens frequently around doors, the ignition reaction can be started at a hotter portion of the oven and the wand applicator moved, while the ignition continues, to the adjacent lower temperature area to be repaired.

The following examples summarize the most preferred embodiments of the invention, including the most preferred proportions of individual components. The iron oxide is $Fe_2O_3$. In each case, the composition was sprayed into a hot coke oven wall at various temperatures using a conventional wand adapted to vary the ratio of oxygen to air. The applied rate of composition, fed into the wand by a mixing hopper, was varied from 1.5 to 10 lbs./min., depending upon the size and angle of the wand. Air was supplied at approximately 60 psi gauge with a valve setting ranging from 40–100% of the valve opening.

EXAMPLE I

This example illustrates application of the composition to a relatively hot oven wall, e.g. one having an initial temperature of about 1500° F.

Silica Base Composition

| Material | Proportions % by wt. Pfd. range | Proportions % by wt. Example | Mesh Size |
|---|---|---|---|
| Crushed Silica Brick | 30–40 | 30 | −16 |
| Silica Sand | 35–45 | 45 | −40 |
| 5238 Al Powder | 9–11 | 10 | −100 |
| 105 AP Powder | 3–5 | 3.5 | −325 |
| Fluorospar | 3–5 | 3.5 | −60 |
| Iron Oxide | 6–8 | 6.0 | −200 |
| Dross | 2–6 | 2.0 | −16 |

At temperatures above 1800° F. in the oven, no oxygen was needed to sustain the reaction. As the temperature fell below 1800° F., increasing amounts of oxygen were needed to initiate and sustain the reaction. For example, in those cases where the oven wall temperature was around 1500° F., a 40% oxygen valve setting was required for the initiating blast and the technician could then lower the oxygen valve setting to about 10% after the heat of fusion was established by the exothermic reaction. The proportions of oxygen were based on oxygen added at 100 psi gauge to the air supply maintained at 60 psi gauge, using a ball valve to open and close the supply of oxygen.

EXAMPLE II

In this example, the composition was controlled to initiate burn at lower temperatures near the door area of the oven, i.e. at about 600°-800° F., using a high setting of the oxygen blend with a valve opening of 70-100% at 100 psi, again using an air supply of 60 psi gauge. The composition was applied at a rate of about 1.5 lbs./min.

| Clay Base Composition | | | |
|---|---|---|---|
| | Proportions % by wt. | | Mesh |
| Material | Pfd. range | Example | Size |
| Crushed fire brick clay | 40 | 40 | −16 |
| Silica Sand | 27.5-35 | 35 | −40 |
| 5238 Al Powder (100+ micron size) | 9-11 | 10 | −100 |
| 105 Al Powder (5 micron size) | 3-5 | 3.5 | −325 |
| Fluorospar | 3-5 | 3.5 | −60 |
| Iron Oxide | 6-8 | 6.0 | −200 |
| Dross | 2-6 | 2.0 | −16 |

As in the preceding example, the amount of oxygen could be reduced after the exothermic reaction the temperature. However, where only small voids need to be filled, it is possible to work at low rates of material supply with a rapidly initiated reaction even at low temperatures. Once the reaction is initiated, the wand can be gradually removed to a new area, even at low wall temperatures.

The invention is hereby claimed as follows:

1. In a ceramic welding process for the repair of a hot oven wall having an initial temperature of not higher than about 3500° F. wherein a finely divided welding composition containing a refractory material intimately admixed with an exothermically oxidizable metal is transported and sprayed onto the wall by an oxygen-containing gas to ignite the composition and fuse it to said wall, the improvement which comprises:

transporting and applying to said wall a welding composition containing in intimate admixture—(A) a substantially noncombustible refractory material in a major proportion with reference to the total weight of the composition,—(B) exothermically oxidizable metal components consisting essentially of (1) a granular aluminum powder having a size range of about 70 to 150 microns in a proportion of about 8 to 12% by weight with reference to the total composition and (2) a finely grained aluminum powder or aluminum flake in which the powder has a size range of less than 5 microns and the flake has an equivalent size by volume, in a proportion of about 2 to 6% by weight with reference to the total composition, and—(C) a group of control components consisting essentially of (1) iron oxide of the formula $Fe_2O_3$ with a particle size of about 80 microns or less in a proportion of about 2 to 10% by weight with reference to the total composition, (2) a dross obtained as the byproduct of aluminum smelting, containing about 15-25% Al, 60-70% $Al_2O_3$ and 10-15% NaCl or KCl, said dross having a particle size of about 70 microns or less and being used in a proportion of about 1 to 7% by weight of the total composition, and (3) a fluorspar having a fluoride content of at least about 70%, said fluorspar having a particle size of about 150 microns or less and being used in a proportion of about 2-7% by weight with reference to the total composition.

2. An improved process as claimed in claim 1 wherein at an oven wall temperature of more than about 1800° F., air without added oxygen is used as the gas to ignite the composition.

3. An improved process as claimed in claim 1 wherein at an oven wall temperature below about 1800° F., oxygen is added to air for use as the gas to ignite the composition.

4. An improved process as claimed in claim 3 wherein the amount of oxygen in the gas used to spray the welding composition is varied between a higher amount of oxygen in order to ignite the composition and a substantially lower amount of oxygen in order to sustain the exothermic fusion reaction, and proportion of oxygen added to air is increased with decreasing wall temperatures.

5. An improved process as claimed in claim 1 wherein the color and shape of the flame is adjusted by varying the proportions of at least one of the components identified as the dross (C)(2) and the fluorspar (C)(3).

6. An improved process as claimed in claim 1 wherein the rate of the exothermic reaction is adjusted by varying the proportion of the iron oxide component (C)(1).

7. An improved process as claimed in claim 1 wherein the process is carried out to repair a coke oven wall having an initial wall temperature of not more than about 1800° F.

* * * * *